US007024835B2

(12) United States Patent
Payne et al.

(10) Patent No.: US 7,024,835 B2
(45) Date of Patent: Apr. 11, 2006

(54) APPARATUS AND METHOD FOR OPENING SEALED CONTAINERS

(75) Inventors: David M. Payne, Star, ID (US); C. Troy Jensen, Caldwell, ID (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 190 days.

(21) Appl. No.: 10/000,976

(22) Filed: Oct. 24, 2001

(65) Prior Publication Data

US 2003/0074867 A1 Apr. 24, 2003

(51) Int. Cl.
*B65B 5/04* (2006.01)

(52) U.S. Cl. ..... 53/449; 53/467; 53/133.3

(58) Field of Classification Search ..... 53/449, 53/492, 467, 412, 415, 169, 133.3; 206/389, 206/395

See application file for complete search history.

(56) References Cited

U.S. PATENT DOCUMENTS

| | | | | | |
|---|---|---|---|---|---|
| 3,326,364 | A * | 6/1967 | Waldrop et al. | ..... | 206/466 |
| 3,999,654 | A * | 12/1976 | Pollack | ..... | 206/216 |
| 4,062,385 | A * | 12/1977 | Katusha et al. | ..... | 141/89 |
| 4,065,335 | A * | 12/1977 | Pollack | ..... | 53/412 |
| 4,502,514 | A * | 3/1985 | Ballard et al. | ..... | 141/1 |
| 4,732,277 | A * | 3/1988 | Smith | ..... | 229/123.1 |
| 4,981,218 | A * | 1/1991 | Ban et al. | ..... | 229/123.1 |
| 5,239,805 | A * | 8/1993 | Uchida et al. | ..... | 53/412 |
| 6,350,503 | B1 * | 2/2002 | Cheatham et al. | ..... | 428/40.1 |

* cited by examiner

*Primary Examiner*—Stephen F. Gerrity
*Assistant Examiner*—Paul Durand

(57) ABSTRACT

An apparatus and method for opening sealed containers includes, in a container with a removable seal, container packaging, with a removal end and a closed end, conformed to receive and removably retain the container. The seal has a front end and a rear end. A connector connects the seal and the container packaging. In another aspect of the invention, a connector extension is attached to the connector and to the seal.

14 Claims, 2 Drawing Sheets

APPARATUS AND METHOD FOR OPENING SEALED CONTAINERS

FIELD OF THE INVENTION

This invention relates to an apparatus and method for opening sealed containers. In particular, the invention relates, in a container with a removable seal, to an apparatus for removing the seal by means of a connection between the container packaging and the seal.

BACKGROUND OF THE INVENTION

Many containers hold materials that are designed to be systematically released from the container once a seal has been removed from the container. By way of explanation and not limitation, toner cartridges, for example, have seals that are in place to prevent toner leakage from occurring during shipment. These seals must be removed prior to installation and printing. Unfortunately, what is obvious to manufacturers is not always obvious to end users. Often times, customers forget to remove the seal, also called a pull strip, and/or toner dam, from the toner cartridge. This generates expensive phone calls to manufacturers, increasing warranty costs to the manufacturer and stress to the end-user.

A wide variety of prior art solutions have been attempted. So called automatic seal removers have been incorporated with prior art printer mechanisms. Unfortunately, the prior art printer mechanisms that are designed to automatically remove toner dams/seals are expensive, complicated and prone to failure.

Thus, there is a need in the art for providing an apparatus and method that automatically removes seals from containers that is inexpensive and essentially foolproof such that containers with seals that are to be removed prior to use are removed as an integral part of the process of removing the container from shipment packaging.

SUMMARY OF THE INVENTION

Accordingly, the apparatus and method for opening sealed containers of the present invention includes, in a container with a removable seal, container packaging conformed to receive and removably retain the container. The seal has a front end and a rear end. A connector connects the seal and the container packaging.

In another aspect of the invention, a connector extension is attached to the connector and to the seal. In a further aspect of the invention, the connector is connected to a removal end of the container packaging and to the front end of the seal.

In another aspect of the invention, a connector is connected to a closed end of the container packaging and the connector extension is connected to the front end of the seal. In a further aspect of the invention, the connector is connected somewhere between the removal end and the closed end of the container packaging.

In another preferred embodiment of the invention, in a system utilizing a toner cartridge with a seal, an apparatus for removing the seal includes a toner cartridge container with an opening covered by a removable seal, the seal having a first end and a second end. A toner cartridge container package conformed to receive and removably retain the toner cartridge container is provided. A connector connects the removable seal and the toner cartridge container package.

In one aspect of the invention, a connector extension is attached to the connector and to the removable seal. In a further aspect of the invention, the connector is connected to the first end of the removable seal and to the toner cartridge container package adjacent to the first end of the removable seal.

In yet another aspect of the invention, the connector is connected to the toner cartridge container package in an area of the toner cartridge container package adjacent the second end of the removable seal and the connector extension is connected to the first end of the seal. In a further aspect of this invention, the connector is connected to the toner cartridge container package in an area of cartridge container package between the first and second end of the removable seal and the connector extension is connected to the first end of the removable seal.

In a preferred embodiment of the method of the invention, the method for removing a seal from a container includes the steps of creating a container packaging conformed to receive and removably retain the container. The container with a seal, with a first end and a second end, is inserted in the container packaging. The container packaging is connected to the first end of the seal. The container packaging is closed. The removal end of the container packaging is opened, after shipment, and, finally, the container is removed from the container packaging thereby removing the seal from the container.

In a further aspect of the method of the invention, a connector extension is connected to the connector and to the first end of the seal. In yet a further aspect of the invention, the connector is connected to a removal end of the container packaging. In another aspect of the invention, the connector is connected to a closed end of the container packaging and the connector extension is connected to the first end of the seal. In another aspect of the invention the connector is connected to the container packaging between a removal end and a closed end of the container packaging.

DESCRIPTION OF THE DRAWINGS

Other objects, features, and advantages of the present invention will become more fully apparent from the following detailed description of the preferred embodiment, the appended claims and the accompanying drawings in which:

DETAILED DESCRIPTION OF THE INVENTION

Figure 1:
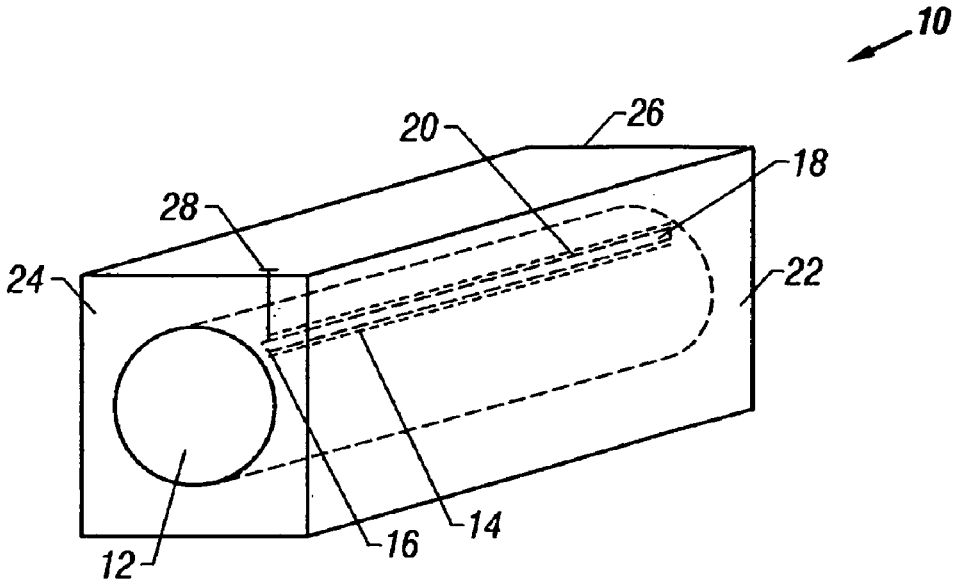
FIG. 1 is a plan view illustration of the apparatus for opening sealed containers of the present invention.
Figure 2:
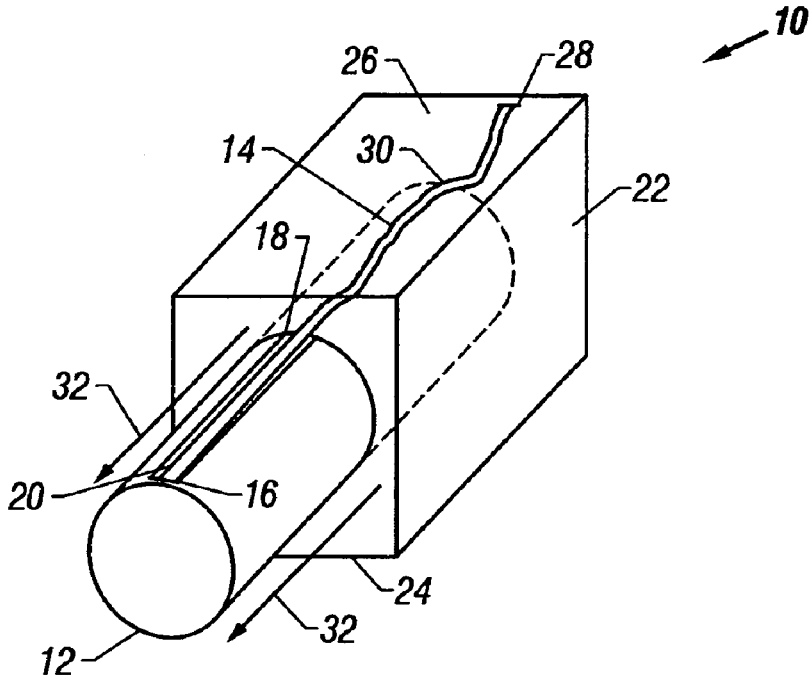
FIG. 2 is an illustration of a further embodiment of the invention of FIG. 1.
Figure 3:
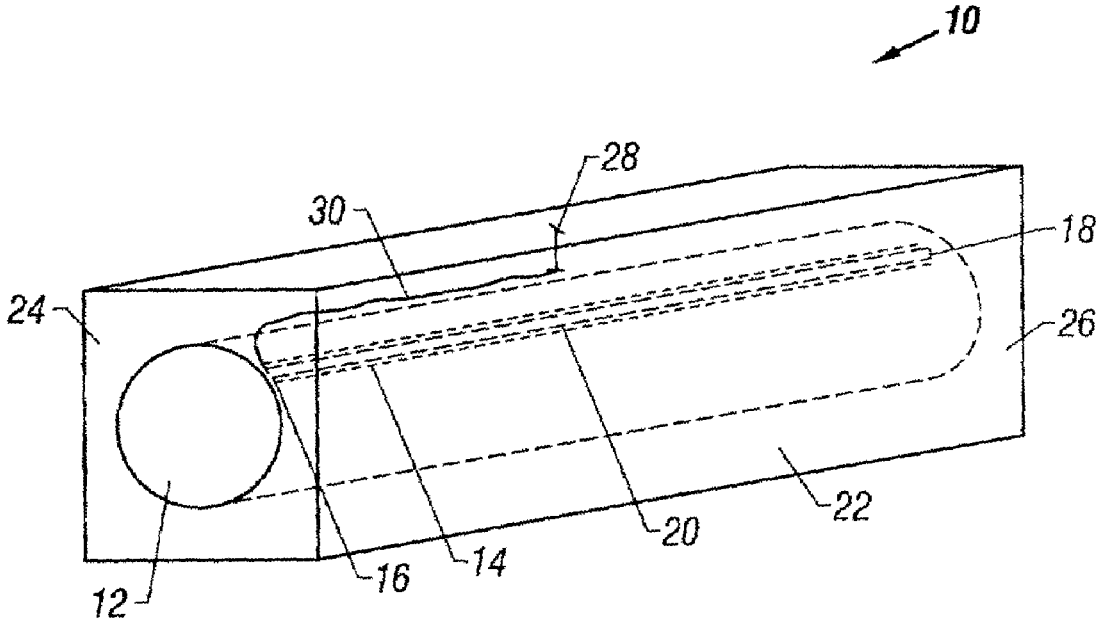
FIG. 3 is an illustration of a further embodiment of the invention of FIGS. 1 and 2.

The preferred embodiment of the present invention is illustrated by way of example in FIGS. 1–3. With specific reference to FIG. 1, the apparatus for opening sealed containers 10 of the present invention includes container 12 with a removable seal 14. Removable seal 14 has a front end 16 and a rear end 18. Removable seal 14 covers window 20 in container 12. Container packaging 22 typically has a removal end 24 and a closed end 26, although container packaging 22 can be opened anywhere and still function in accordance with the present invention. Container packaging 22 is conformed to receive and removably retain container 12. Connector 28 connects the removable seal 14 and container packaging 22.

Container 12 is any container type vessel now known or hereafter developed. By way of example, and not by limitation, container 12 may take the form of a toner cartridge. In that case, container 12 holds toner for a typical printer. Removable seal 14 covers window 20 while container 12 is shipped thereby ensuring that the toner does not spill out. Certainly any other type of material is encompassed within the scope of the present invention.

Additionally, removable seal 14 is any type of removable seal now known or hereafter developed including resilient plastic adhesive tapes, adhesive vinyl strips, and so forth. So long as the seal material selected is removable, the type of material the removable seal 14 is made of is of no inventive importance. In practice and in fact, container packaging 22 and removable seal 14 may be made of the same material, excluding any adhesive where appropriate.

Connector 28 preferably is comprised of the same resilient material as removable seal 14 (and or container packaging 22 as indicated above), without any adhesive that may be present on removable seal 14. As illustrated in FIG. 1, connector 28 is connected to container packaging 22 at removal end 24. The connection to the container packaging 22 can be of any convenient type now known or hereafter developed including glue, epoxy, heat seal, stitching and the like. Importantly, in the embodiment disclosed in FIG. 1, connector 28 is attached to the removal end 24 in close proximity to front end 16 of removable seal 14. It should be noted that while the connector 28 is a specific item of the invention and integral to its function, connector 28 includes simply the location where removable seal 14 is fused or otherwise connected to container packaging 22. Likewise, as discussed more fully hereafter, connector extension 30 may also simply be an extension of removable seal 14 and an integral part thereof.

While container packaging 22 is shown in rectangular form in the Figures, it is to be understood by those of ordinary skill in the art that container packaging 22 may take any form desirable for removably retaining container 12 for shipment. It could, for example only, be vacuum shrunk or form fit or made of foam material.

In operation, once container packaging 22 and the front end 16 of removable seal 14 have been connected, by means of connector 28, the apparatus for opening sealed containers 10 of the present invention is in position for expeditious use by the end-user. All the end-user must do at this point is open the container packaging 22, again, typically at removal end 24, and withdraw container 12. Because the container packaging 22 and the front end 16 of removable seal 14 are connected, as container 12 is withdrawn from container packaging 22, removable seal 14 is removed from container 12 thereby exposing window 20 in a single simple step. Most importantly, removable seal 14 has been removed in the ordinary course of removing container 12 from container packaging 22 so that the chances of the user inadvertently loading container 12 with removable seal 14 still in place are almost completely eliminated.

It should be noted, that container packaging 22 and removable seal 14 may be connected after container 12 has been inserted into container packaging 22.

Referring now to FIG. 2, in a preferred embodiment, apparatus for opening sealed containers 10 of the present invention includes connector extension 30. Connector extension 30 is attached to connector 28 and to the front end 16 of removable seal 14 as illustrated. Connector extension 30, in a preferred embodiment, is formed from the same type of material as removable seal 14, for example. Connector extension 30 enables a user to partially remove container 12, in the direction of direction arrows 32, from container packaging 22 prior to the beginning of the removal of removable seal 14 from container 12. This provides for ease of handling and control of container 12 and helps ensure against spilling the contents of container 12 during the removal process. As shown in FIG. 2, connector 28 is attached to the container packaging 22 at the closed end 26. Once again, for clarification, connector extension 30 may simply be a long end of removable seal 14 not used to cover the window 20 of container 12. That is to say, it is encompassed by the invention, that connector extension 30 is not a separate item but a separate function for part of the removable seal 14.

It should be noted that connector 28, and/or connector extension 30, may be connected to removable seal 14 at locations other than front end 16. This location is illustrated, in these examples, to show the full removal of removable seal 14 from window 20. Obviously, there may be circumstances when only a part of removable seal 14 needs to be removed. In such a situation, obviously, connector 28, and/or connector extension 30, may be attached to removable seal 14 at any appropriate position along the entire length of removable seal 14.

Referring now to FIG. 3, a further embodiment of the apparatus for opening sealed containers 10 of the present invention is provided. As illustrated, in this embodiment, connector 28 is attached to container packaging 22 somewhere in between front end 16 and rear end 18 of removable seal 14. That is, connector 28 is attached to some portion of container packaging 22 that is adjacent to some part of removable seal 14 anywhere along its entire length.

In use, then, container packaging 22, with a removal end 20 and a closed end 26, is created such that it is conformed to receive and removably retain container 12. Container 12 with a removable seal 14, with a first end 16 and a second end 18, is inserted within container packaging 22. Container packaging 22 and the first end 16 of the seal 14 are then connected. Container packaging 22 is then closed for shipping. Upon arrival at the user's location, the user simply opens container packaging 22 and removes the container 12 from the container packaging 22 thereby removing the seal 14 from container 12 by means of the connection 28 to both the container packaging 22 and the front end 16 of removable seal 14.

The description of the present embodiments of the invention have been presented for purposes of illustration and are not intended to be exhaustive or to limit the invention to the form disclosed. Many modifications and variations will be apparent to those of ordinary skill in the art. As such, while the present invention has been disclosed in connection with the preferred embodiment thereof, it should be understood that there may be other embodiments which fall within the spirit and scope of the invention as defined by the following claims.

What is claimed is:

1. In a container with a removable seal, an apparatus for removing the seal, the apparatus comprising:

a) container packaging, with a removal end and a closed end, conformed to receive and removably retain said container;

b) said seal having a front end and a rear end;

c) a connector connecting said seal and said container packaging; and d) a connector extension attached to said connector and to said seal wherein said connector is connected to said container packaging and said connector extension is connected to said front end of said seal wherein said connector extension is of a length such that said container may be partially removed from said removal end of said container packaging without removing said seal.

2. The apparatus of claim 1 wherein said connector is connected to said removal end of said container packaging and to said front end of said seal.

3. The apparatus of claim 1 wherein said connector is connected between said removal end and said closed end of said container packaging.

4. An apparatus for removing a seal from a container, the apparatus comprising:

a) a container with a seal with a front end and a rear end;

b) a container package, with a removal end and a closed end, conformed to removably contain the container;

c) a connector connected to the container package; and d) a connector extension attached to the connector and to the seal wherein the connector is connected to the container package and the connector extension is connected to the front end of the seal wherein said connector extension is of a length such that the container may be partially removed from the removal end of the container package without removing the seal.

5. The apparatus of claim 4 wherein the connector is connected to the removal end of the container package and to the front end of the seal.

6. The apparatus of claim 4 wherein the connector is connected between the removal end and the closed end of the container package.

7. In a system utilizing a toner cartridge with a seal, an apparatus for removing the seal comprising:

a) a toner cartridge container with an opening covered by a removable seal, the seal having a first end and a second end;

b) a toner cartridge container package conformed to receive and removably retain the toner cartridge container the toner cartridge container package including a removal end and a closed end;

c) a connector connecting the removable seal and the toner cartridge container package; and d) a connector extension attached to the connector and to the removable seal wherein the connector is connected to the toner cartridge container package in an area of the toner cartridge container package adjacent the second end of the removable seal and the connector extension is connected to the first end of the removable seal wherein said connector extension is of a length such that the toner cartridge container may be partially removed from the removal end of the toner cartridge container package without removing the seal.

8. The apparatus of claim 7 wherein the connector is connected to the first end of the removable seal and to the toner cartridge container package adjacent the first end of the removable seal.

9. The apparatus of claim 7 wherein the connector is connected to the toner cartridge container package in an area of the toner cartridge container package between the first and second ends of the removable seal and the connector extension is connected to the first end of the removable seal.

10. A method for removing a seal from a container, the method comprising the steps of:

a) creating a container packaging, with a removal end and a closed end, conformed to receive and removably retain the container;

b) inserting the container with a seal, with a first end and a second end, in the container packaging;

c) connecting a connector to the container packaging and to the second end of the seal wherein said connector extension is of a length to allow the container to be partially removed from the removal end of the container packaging before removing the seal;

d) attaching a connector extension to the first end of the seal and to the connector;

e) opening the removal end of the container packaging; and f) partially removing the container from the removal end of the container packaging before removing the seal from the container.

11. The method of claim 10 further comprising the step of adding a connector extension connected to the connector and to the first end of the seal.

12. The method of claim 10 wherein in step c) the connector is connected to the removal end of the container packaging and to the first end of the seal.

13. The method of claim 11 wherein in step c) the connector is connected to the closed end of the container packaging and the connector extension is connected to the first end of the seal.

14. The method of claim 11 wherein in step c) the connector is connected to the container packaging between the removal end and the closed end.

* * * * *